US007513186B2

(12) United States Patent
Ravid et al.

(10) Patent No.: US 7,513,186 B2
(45) Date of Patent: Apr. 7, 2009

(54) BALLISTIC ARMOR

(75) Inventors: Moshe Ravid, Hod Hasharon (IL); Yoav Hirschberg, Merom Hagalil (IL)

(73) Assignee: Plasan-Kibbutz Sasa, M.P. Marom Hagalil (IL)

( * ) Notice: Subject to any disclaimer, the term of this patent is extended or adjusted under 35 U.S.C. 154(b) by 0 days.

(21) Appl. No.: 11/039,832

(22) Filed: Jan. 24, 2005

(65) Prior Publication Data

US 2005/0257677 A1 Nov. 24, 2005

(30) Foreign Application Priority Data

Mar. 11, 2004 (IL) ..... 160843

(51) Int. Cl.
*F41H 5/00* (2006.01)
*F41H 5/02* (2006.01)
*F41H 5/013* (2006.01)

(52) U.S. Cl. ..... 89/36.02

(58) Field of Classification Search ..... 89/36.01–36.16
See application file for complete search history.

(56) References Cited

U.S. PATENT DOCUMENTS

| | | | | |
|---|---|---|---|---|
| 4,398,446 | A | 8/1983 | Pagano et al. | |
| 4,545,286 | A * | 10/1985 | Fedij | 89/36.02 |
| 4,835,033 | A | 5/1989 | Auyer et al. | |
| 4,965,138 | A * | 10/1990 | Gonzalez | 428/593 |
| 5,007,326 | A | 4/1991 | Gooch, Jr. et al. | |
| 5,014,592 | A | 5/1991 | Zweig | |
| 5,221,807 | A | 6/1993 | Vives | |
| 5,293,806 | A | 3/1994 | Gonzalez | |
| 5,972,819 | A | 10/1999 | Cohen | |
| 6,523,450 | B1 | 2/2003 | Schreiber | |

FOREIGN PATENT DOCUMENTS

| | | |
|---|---|---|
| CH | 23749 | 9/1902 |
| EP | 209221 | 1/1987 |
| EP | 0209221 A1 | 1/1987 |
| EP | 0 334 263 A1 * | 9/1989 |
| EP | 334263 | 9/1989 |
| EP | 0 699 887 A2 | 3/1996 |
| EP | 0959321 A1 | 11/1999 |
| EP | 1 128 154 A2 | 8/2001 |
| FR | 503320 | 6/1920 |
| FR | 516475 | 4/1921 |
| FR | 909792 | 5/1946 |
| WO | WO 99/50612 | 10/1999 |

* cited by examiner

*Primary Examiner*—Bret Hayes
(74) *Attorney, Agent, or Firm*—The Nath Law Group; Jerald L. Meyer; Jiaxiao Zhang

(57) ABSTRACT

An armor designed for ballistic protection against armor piercing projectiles, comprises a main armor plate including a layer which is at least partially made of a ballistic material, e.g. in the form of a plurality of bodies, and an auxiliary armor plate at least partially made of a ballistic material. The auxiliary plate is located in front of the main armor plate and is spaced therefrom by an area, which is at least partially free of any additional layers. The auxiliary plate has through holes spaced from each other, which are free of any ballistic material.

18 Claims, 1 Drawing Sheet

BALLISTIC ARMOR

FIELD OF THE INVENTION

This invention relates to multi-layer ballistic armor and, particularly, to such armor, which is suitable for use as add-on (exterior) armor for military vehicles.

BACKGROUND OF THE INVENTION

U.S. Pat. No. 6,523,450 discloses an add-on armor in the form of a multi-layer panel adapted for the external attachment to the bottom of a helicopter at a distance 2" therefrom. The panel comprises an inner layer made of ceramic material, an outer layer, which may be polyurethane, and a middle layer therebetween which is in contact with both inner and outer layer and which may be of aramid polyamide.

U.S. Pat. No. 4,398,446 discloses different add-on armor arrangements designed for the attachment to a side wall of a military vehicle to provide different levels of ballistic protection. The difference in the arrangements is mainly in the number of armor layers and their location relative to the vehicle's side wall. In particular, in some arrangements where only one armor layer is used, it is mounted either directly or close to the vehicle's side wall or at a location spaced therefrom by spacers, whilst in the arrangements where two armor layers are used, one of them is mounted directly or close to the vehicle's side wall and the other—at a location spaced therefrom. In all the cases, each armor layer is comprised of tiles whose edges abut each other to define a substantially uninterrupted armor surface. The material from which the tiles are made may be any conventional structural materials with anti-ballistic properties, such as a composite ceramic material.

U.S. Pat. No. 5,221,807 discloses a ballistic armor with front and rear layers, which are spaced from each other by a spacing layer. The front layer is made of a ceramic material formed with blind holes, and it is designed to score impacting projectiles before they strike the rear layer, which functions as a main armor layer. The rear, main armor layer may be in the form of a two-layer plate in which one of the layers is made of sintered ceramic and the other layer is made of Kevlar™, ceramic matrix composite or steel.

SUMMARY OF THE INVENTION

In accordance with the present invention, there is provided an armor designed for ballistic protection against armor piercing projectiles, the armor comprising a main armor plate including a layer at least partially made of a ballistic material, and an auxiliary armor plate at least partially made of a ballistic material, located in front of the main armor plate and spaced therefrom by an area, which is at least partially free of any additional layers, said auxiliary plate having through holes spaced from each other, which are free of any ballistic material.

In the present application, the term "ballistic material" means a hard material capable of ballistic performance.

The auxiliary plate in the armor of the present invention is preferably designed to deflect and initially shatter or at least destabilize at least those projectiles, among the projectiles against which the armor has to provide ballistic protection, which cannot be stopped by the main plate alone or with a surface to be protected. The main armor plate in the armor of the present invention is preferably designed to provide required ballistic protection against a wide range of projectiles including not only those which, when penetrating said auxiliary plate, have been deflected and shattered or destabilized thereby, but also against projectiles with a relatively small cross-sectional area, which have a theoretical chance to pass through a hole in the auxiliary plate without having been influenced thereby. The level of ballistic protection to be provided by the main armor plate depends on whether the surface, which the armor is intended to protect, has its own ballistic capability. If it has such capability, which may be for example in the case when the surface is a military vehicle's basic structure (made of a metal, such as steel or aluminum, with or without a laminate, such fiberglass, Kevlar™ or aluminum), the level of ballistic protection provided by the main armor plate may be lower than in the case when the surface to be protected does not have any ballistic capability.

The auxiliary plate in the armor of the present invention may be made of a solid material, such as metal. The through holes in the plate should have a cross-sectional area that is smaller than a cross-sectional area of a projectile which cannot be stopped by the main plate alone or with the surface to be protected, but that is still large enough to be felt by such a projectile, when impacting the hole. The holes may have the same or different cross-sectional shape, which may be regular, i.e. circular, oval, square, rectangular, triangular, etc., or may be irregular. The holes may be in the form of slits or the like, and their arrangement may be regular, e.g. staggered, or irregular.

Alternatively, the auxiliary plate may be a composite plate, for example, a plate having a layer of ceramic pellets held in abutting relationship by a thermoplastic or thermosetting material, where the islands of the latter material between adjacent pellets constitute the holes that are free of any ballistic material and that function similarly to the holes in a metal plate.

In the main armor plate, said layer may include a plurality of bodies and constitute a front layer and the plate may further include a backing layer. In this case, it is preferable that the front layer is designed to shatter projectiles (or their parts) penetrated or passed through the auxiliary plate, into small fragments, and the backing layer is designed to finally stop the fragments, possibly together with the surface to be protected.

In the front layer of the main armor plate, the bodies may be in the form of tiles or pellets made of ceramic material held in the layer by a non-ceramic, thermoplastic or thermosetting, material. The tiles may have a square or rectangular shape and a thickness smaller than the length of tile's sides. The tile's cross-sectional area is normally essentially greater than the maximal cross-sectional area of the projectiles for which the armor is designed. The pellets' cross-sectional area should preferably not be smaller than the cross-sectional area of a projectile which the main plate alone (or together with the protected surface) should be capable to stop. The pellets may have any appropriate shape, e.g. they may be cylindrical and some or each of them may have an external layer of a material different from that of which they are made, which material may be in the form of a coating or a shell or belt member surrounding the pellet.

The invention may be applied to various types of military vehicles and may provide ballistic protection against armor piercing projectiles of different diameters such as 7.62 mm, 12.5 mm, 14.5 mm or 20 mm.

The armor having the main and auxiliary plates according to the present invention may surprisingly have a lighter weight than the weight it would need to have in order to provide the same level of ballistic protection, if the armor was comprised only of the auxiliary plate or only the main plate and if these plates were located at the same distance from a surface to be protected, as in the armor of the present invention. Moreover, when used as an add-on armor on a vehicle's basic structure, the armor of the present invention may allow a much smaller distance between the auxiliary plate and the basic structure, than the distance it would need to have to provide the same level of ballistic protection, if the armor had the same weight and comprised only the auxiliary plate and did not comprise the main armor plate. In particular, the distance between the auxiliary plate and a surface to be protected may be decreased by 50% or even more compared to the distance which the armor would need to have in order to provide the same level of ballistic protection, if it had the same weight and included only the auxiliary layer.

The above may be partially explained by the combined effect of:

- the auxiliary plate with holes, which may cause a projectile, when penetrating said auxiliary plate, to be deflected and to further be initially shattered or at least destabilized;
- the spacing between the auxiliary and the main plates, which allows the deflected projectile's path to further deviate from a normal impact on the main plate, or allows the projectile's parts to be more separated in space between their impact on the main plate; and
- an improved multi-hit capability, which the main plate may have due to its comprising a layer of hard bodies.

BRIEF DESCRIPTION OF THE DRAWINGS

In order to understand the invention and to see how it may be carried out in practice, an embodiment will now be described, by way of non-limiting example only, with reference to the accompanying drawings, in which.

DETAILED DESCRIPTION OF EMBODIMENT

Figure 1:
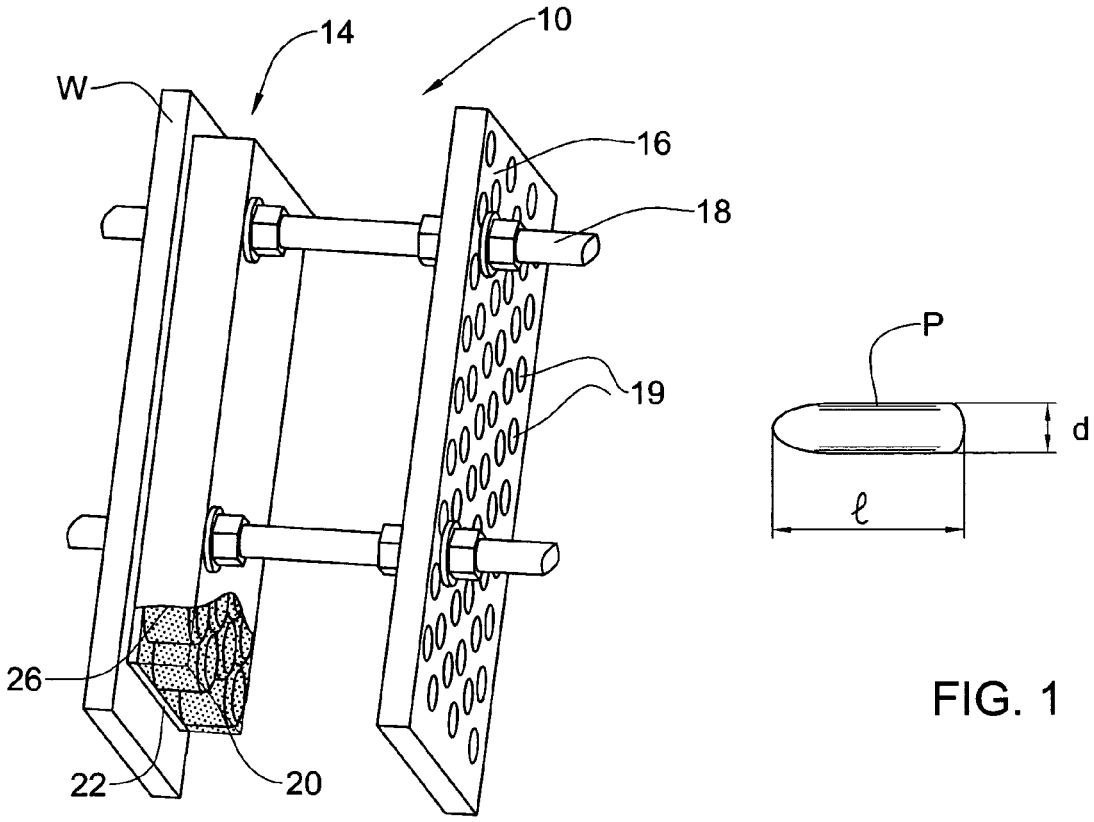
FIG. 1 is a schematic perspective view of a ballistic armor in accordance with an embodiment of the present invention.
Figure 2:
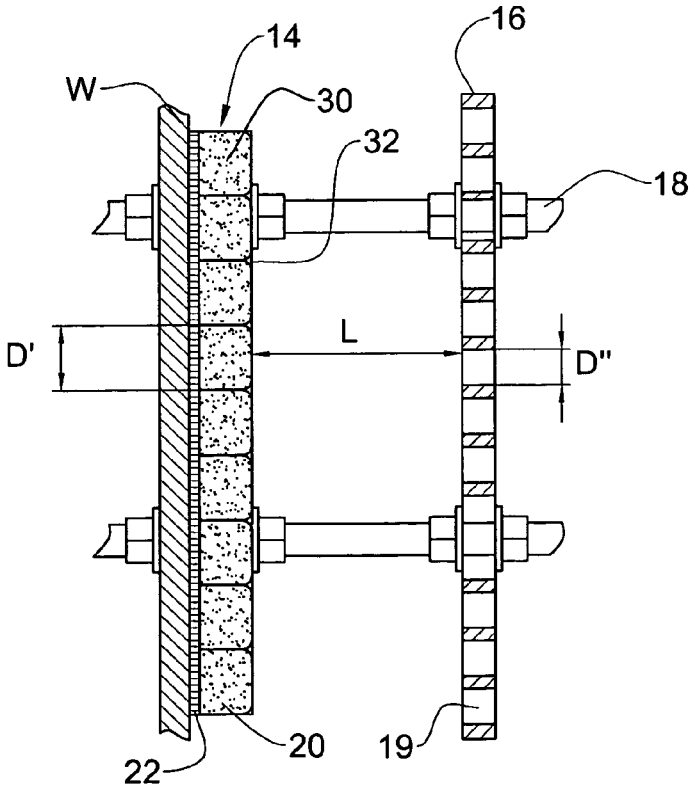
FIG. 2 is a cross-sectional view of the armor shown in FIG. 1.

An armor 10 schematically shown in FIGS. 1 and 2, is one example of ballistic armor of the present invention designed for ballistic protection of a basic structure, e.g. side wall W of a vehicle (not shown), against armor piercing projectiles P.

The armor 10 comprises a main armor plate 14 and an auxiliary armor plate 16 located in front of the main armor plate 14. The plates 14 and 16 may be attached to the side wall W by common attachment means 18 as shown in FIG. 1, or the main armor plate 14 may be attached to the side wall W by one attachment means and the auxiliary plate 16 may be attached to the main plate 14 or to the side wall by another attachment means (not shown). In any case, the attachment means may have any appropriate design suitable to keep the plates in place at fixed distance from each other and from the side wall W.

The main plate 14 is a composite armor plate designed to stop alone, or together with the side wall W but without the auxiliary plate 16, at least those projectiles P, whose diameter (hereinafter '$d_{min}$) is relatively small.

The main plate 14 comprises a front layer 20 and a rear, backing layer 22 bonded to the front layer. The front layer 20 comprises cylindrical pellets 30 abutting each other, made of ceramic, for example alumina, and held by a synthetic resin material 32. The ceramic pellets 30 have a diameter D' about, or preferably greater than, the diameter $d_{min}$. For example, the diameter D' may meet the condition: $1.5d_{min} \leqq D' \leqq 3.5d_{min}$. The rear layer 22 may itself be multi-layered and it may be made of aluminum, fiberglass, aramid fiber material such as Kevlar™ or a combination thereof. The plate 14 may further include a wrapping layer 26, which may also be Kevlar™.

The auxiliary plate 16 is designed to deflect and shatter or at least destabilize at least those projectiles whose length and diameter are relatively large (hereinafter l.sub.max and d.sub-.max, respectively), and which cannot be stopped by the main plate 16 alone or together with the side wall W.

The auxiliary plate 16 may be made of steel, titanium or the like, and it is formed with cylindrical through holes 19 spaced from each other to a distance smaller than their diameter D". The diameter D" is smaller than $d_{max}$ but it should be large enough to be felt by a projectile having such diameter, when impacting the hole. The range of D" may be $d_{min} < D'' \leqq d_{max}$, preferably $1.2d_{min} < D'' \leqq 0.9d_{max}$. The total area of the holes 40 may be about between 40% and 50% of the area of the auxiliary plate 16.

The distance L between the auxiliary and the main plates is about the length $l_{max}$. The distance L may be greater than $l_{max}$ but it preferably should not exceed about 1.1 $l_{max}$. A possible range for the distance L may be, for example, $0.9\ l_{max} \leqq L \leqq 1.5\ l_{max}$.

The armor as described above may be produced as a module with the auxiliary plate fixedly attached to the main plate. The module may be provided with means for mounting it on the vehicle's side wall W, which may be protected by a number of such modules.

In operation, a projectile P impacts the auxiliary plate 16 and, while penetrating the plate, is deflected (its path is deviated from the normal direction thereof) and initially shattered or at least destabilized. The destabilized and deflected projectile or parts thereof (or the whole projectile, if it is smaller in diameter than the holes of the auxiliary plate 16 and by chance has passed through one such hole), then impact the front layer 20 of the main plate 14, which further shatters the projectile or its parts into small fragments. The backing layer 22 absorbs and dissipates kinetic energy of the fragments on the protected side wall W, at which the projectile is finally stopped. If the protected side wall W is not adapted to provide a certain level of ballistic protection, the main armor plate 16 would need to be designed so that its backing layer finally stops the fragments of the projectile by absorbing their kinetic energy.

An experiment has been performed on a ballistic armor having the above described design, attached to an 8 mm thick steel (RHA) side wall of a vehicle so that the auxiliary plate of the armor is spaced from the wall to a distance 95 mm.

The armor had the following parameters:

Auxiliary Armot Plate:

| Auxiliary Armor Plate: | |
|---|---|
| Material | steel; |
| Weight | 37 kg/m$^2$ |
| Diameter of holes | 11 mm |
| Distance between the holes | 4 mm |
| Thickness | 8 mm |

Main Armor Plate (Module marketed by the Applicant under the trade name SMART™):

Ceramic Pellets in the Front Layer:

| Ceramic pellets in the front layer: | |
|---|---|
| material | Alumina 98.% |
| diameter | 19 mm |
| height | 16 mm |
| Backing: | |
| Material | fiberglass |
| Thickness | 3 mm |
| Wrapping | Kevlar ™ 0.5 mm thick |

The armor weighted 94 kg/m$^2$ and it successfully stopped, together with the vehicle's side wall, armor piercing projectiles 14.5 mm API B 32. A conventional add-on armor comprised solely of a perforated steel plate having the same design as the auxiliary plate in the armor of the present invention, spaced from the vehicle's side wall to the same distance as mentioned above, would need to have a weight at least 1.5 greater than that of the armor of the present invention, in order to provide the same level of ballistic protection. If, on the other hand, the conventional armor had the same weight as the armor of the present invention, the distance between the conventional armor and the vehicle's side wall would need to be more than twice the distance between the side wall and the auxiliary plate of the armor of the present invention, to provide the same level of ballistic protection.

Clearly, different variations and modifications may be introduced in the armor of the present invention, without deviation from the framework of its main concept.

The invention claimed is:

1. An armor designed for ballistic protection against armor piercing projectiles including a first projectile having a first diameter and a second projectile having a second diameter greater than the first diameter, the armor being configured for mounting on a surface to be protected and comprising a main armor plate being configured to stop alone, or together with said surface to be protected, at least the first projectile, and being incapable of stopping alone, or together with said surface to be protected, the second projectile, and including a layer which is distinct from said surface and at least partially made of a material capable of ballistic performance, said armor further comprising an auxiliary armor plate located in front of the main armor plate and spaced therefrom by an area, which is at least partially free of any additional layers, said auxiliary plate being made of material capable of ballistic performance and having through holes spaced from each other, free of material capable of ballistic performance, said holes being designed in accordance with parameters of the first and second projectiles, such that the holes are larger in cross-section than the first projectile, and smaller in their cross-section than the second projectile.

2. Armor according to claim 1, wherein said layer in the main armor plate comprises a plurality of bodies made of said ballistic material, held together by a thermoplastic or thermosetting material.

3. Armor according to claim 2, wherein said bodies are made of ceramic material.

4. Armor according to claim 2, wherein said bodies abut each other.

5. Armor according to claim 2, wherein said main armor plate further includes a backing layer attached to said layer.

6. Armor according to claim 5, wherein said backing layer is made of a material selected from the group of aluminum, fiberglass, aramid fiber material or a combination thereof.

7. Armor according to claim 1, wherein the distance between the auxiliary armor plate and the main armor plate is greater than the length of the second projectile.

8. Armor according to claim 1, wherein the distance between the auxiliary armor plate and the main armor plate is in the range of between 0.9 and 1.5 of the length of the second projectile.

9. Armor designed for ballistic protection of a surface against armor piercing projectiles including a first projectile having a first diameter and a second projectile having a second diameter greater than the first diameter, the armor being designed for mounting on said surface and comprising a main armor plate configured to stop alone, or together with a surface to be protected, the first projectile and incapable of stopping alone, or together with the surface to be protected, the second projectile, and an auxiliary armor plate at least partially made of a material capable of ballistic performance, located in front of the main armor plate, said auxiliary armor plate having through holes spaced from each other, which are designed in accordance with the diameters of the first and second projectiles, such that the holes are larger in cross-section than the first projectile, and smaller in their cross-section than the second projectile.

10. Armor according to claim 9, wherein the second projectile has a length $l_{max}$, and the distance between the auxiliary armor plate and the main armor plate is greater than $l_{max}$.

11. An armor according to claim 9, wherein said main armor plate comprises a layer comprising a plurality of bodies of about the same or greater cross-sectional dimensions than the second projectile.

12. An armor designed for ballistic protection of a surface against armor piercing projectiles of different diameters including a first, relatively small diameter and a second, relatively large diameter, the armor being configured for mounting to said surface and comprising a main armor plate including a layer which is at least partially made of a material capable of ballistic performance, which is configured to stop alone, or together with a surface to be protected, at least projectiles of the first diameter, and which is incapable of stopping alone, or together with a surface to be protected, projectiles of the second diameter, and an auxiliary armor plate at least partially made of a material capable of ballistic performance, the auxiliary armor plate being located in front of, and being spaced from, the main armor plate, said auxiliary armor plate having through holes spaced from each other, which are large enough to allow a projectile of said first diameter to pass through without being influenced by the hole, and small enough to be felt by a projectile having the second diameter, when impacting such hole.

13. Armor according to claim 12, wherein projectiles of said second diameter have a length $l_{max}$, and the distance between the auxiliary armor plate and the main armor plate is greater than said length $l_{max}$.

14. An armor designed for ballistic protection of surface against armor piercing projectiles of different diameters including a first projectile having a relatively small diameter and a second projectile having a relatively large diameter, the armor being configured for mounting to said surface and comprising a main armor plate including a layer which is at least partially made of a material capable of ballistic performance, and being configured to stop alone, or together with a surface to be protected, at least the first projectile, and being incapable of stopping alone, or together with a surface to be protected, the second projectile; and an auxiliary armor plate located in front of, and being spaced from, the main armor plate; said auxiliary armor plate being at least partially made of a material capable of ballistic performance, and having through holes spaced from each other, which holes are larger in size than the first projectile to allow said first projectile to pass through such hole without being influenced thereby, and smaller in size than the second projectile, to be felt by such second projectile when impacting the hole.

15. Armor according to claim 14, wherein the second projectile has a length $l_{max}$, and the distance between the auxiliary armor plate and the main armor plate is greater than $l_{max}$.

16. An armor designed for ballistic protection of a surface against armor piercing projectiles of different diameters including a first projectile having a first diameter and a second projectile having a second diameter greater than the first diameter, the armor being configured for mounting on said surface and comprising a main armor plate including a layer which is at least partially made of a material capable of ballistic performance, which is configured to stop alone, or together with a surface to be protected, at least the first projectile, and incapable of stopping the second projectile, and an auxiliary armor located in front of the main armor plate and spaced therefrom by an area, which is at least partially free of any additional layers; the armor further comprising an auxiliary plate being at least partially made of a material capable of ballistic performance and being designed to deflect, initially shatter or at least destabilize the second projectile when penetrating the plate; said auxiliary plate having through holes spaced from each other, and capable to allow the first projectile to pass through such hole without having been influenced thereby.

17. Armor according to claim 16, wherein the second projectile has a length $l_{max}$, and the distance between the auxiliary armor plate and the main armor plate is greater than $l_{max}$.

18. An armor designed for ballistic protection against armor piercing projectiles including a first projectile having a first diameter and a second projectile having a second diameter greater than the first diameter, the armor being configured for mounting on a surface to be protected and comprising a main armor plate being configured to stop alone, or together with said surface to be protected, at least the first projectile, and being incapable of stopping alone, or together with said surface to be protected, the second projectile, and including a layer which is distinct from said surface and at least partially made of a material capable of ballistic performance, said armor further comprising an auxiliary armor plate located in front of the main armor plate and spaced therefrom by an area, which is at least partially free of any additional layers, said auxiliary plate being made of material capable of ballistic performance and having through holes spaced from each other, free of material capable of ballistic performance, said holes having a length extending therethrough the auxiliary plate and being designed in accordance with parameters based on the diameters of the first and second projectiles, such that the holes are larger in cross-section perpendicular to the length than said first diameter, and smaller in cross-section perpendicular to the length than said second diameter.

* * * * *